United States Patent [19]

Nikkel et al.

[11] Patent Number: 4,989,787

[45] Date of Patent: Feb. 5, 1991

[54] LIQUID SPRAY GUN ACCESSORIES

[76] Inventors: Robert E. Nikkel, 4101 Mount Vernon Ct., Fort Collins, Colo. 80525; Paul Guidi, 15500 W. Telegraph D-30, Santa Paula, Calif. 93060; John K. Rains, 7074 El Malabar, Ventura, Calif. 93003

[21] Appl. No.: 347,918

[22] Filed: May 5, 1989

[51] Int. Cl.[5] ..... B05B 7/12

[52] U.S. Cl. ..... 239/346; 239/365; 239/390

[58] Field of Search ..... 239/124, 290, 296, 300, 239/341, 346, 353, 365, 373, 366, 390

[56] References Cited

U.S. PATENT DOCUMENTS

| | | | |
|---|---|---|---|
| 2,557,593 | 6/1951 | Björkman | 239/353 X |
| 2,880,940 | 4/1959 | Briggs | 239/373 |
| 2,899,018 | 8/1959 | Booth | 239/366 X |
| 3,796,376 | 3/1974 | Farnsteiner | 239/353 |
| 4,174,071 | 11/1979 | Lau et al. | 239/365 X |
| 4,850,809 | 7/1989 | Smith | 239/354 X |

FOREIGN PATENT DOCUMENTS

| | | | |
|---|---|---|---|
| 383768 | 11/1982 | United Kingdom | 239/353 |

*Primary Examiner*—Andres Kashnikow

*Assistant Examiner*—William Grant

*Attorney, Agent, or Firm*—Frank D. Gilliam

[57] ABSTRACT

The invention is directed to improvements in existing liquid hand held spray guns which deliver liquid to a spray nozzle and have fixed or adjustable spray pattern adjustment of the liquid being dispensed from the nozzle. The improvements comprise the addition of a ball valve between the spray gun internal air flow passage and a container of liquid to be sprayed through the nozzle and a venturi assembly which attaches upstream in a series relationship between the pressurized air input to the gun and the source of pressurized air. The venturi assembly is adaptable to substantially all of the liquid spray guns of the type described and when installed reduces the pressure of the pressurized air entering the gun to 10 PSI or less to comply with governmental environmental pollution standards. With the venturi assembly attached to a given liquid spray gun, the ball valve is employed to provide a slight positive pressure to the container of liquid attached to the gun to control the flow of that liquid from the container into the nozzle. The use of the two assemblies together enhances the flow of liquid to the nozzle and provides environmental acceptable pressure standards to the now non-complying existing liquid spray guns.

11 Claims, 3 Drawing Sheets

LIQUID SPRAY GUN ACCESSORIES

BACKGROUND OF THE INVENTION

The present invention relates to spray guns, and more particularly to the hand held type by which a liquid such as paint is sprayed by the action of compressed air that is delivered through the hollow handle of the spray gun to entrain and atomize the paint and dispense the atomized paint from a storage container associated with the spray gun through a nozzle toward an object to be sprayed with the paint.

In conventionally known paint spray guns high pressure compressed air arrives to the spray head of the gun to draw and atomize the paint from a container generally attached to the gun by means of a paint delivery tube and an adjustable or fixed nozzle. In the past the fact that a tremendous excess of atomized paint was sprayed into the atmosphere while painting and object was of no concern so the level of pressure of the pressurized air entering the gun was not considered so long as a sufficient amount was available to form an atomized quantity and pattern of the paint leaving the gun which was suitable for painting a desired object.

The thought of reducing the pressure of pressurized air for atomizing the paint leaving the gun nozzle was noted in U.S. Pat. No. 3,796,376 issued to inventor Irmgard O. W. Farnsteiner of Monte-Carlo, Monaco. In this patent the air volume is somewhat increased and the pressure is somewhat reduced to a lower than source level by means of a venturi built into the handle which mixed high pressure air with atmospheric air. With a built in system of the configuration of the reference, the pressure reducing and volume increasing system is not adaptable to conventional and existing spray guns. In order to take advantage of a venturi type pressuring reducing and volume maintaining configuration as taught by the Farnsteiner reference all of the existing paint spray guns must be discarded and replaced with a gun with a built in venturi system.

A further disadvantage of the spray gun of the above referenced patent is that the internal gun pressure still exceeds the spray gun operating pressures mandated by Federal, State and local government environmental standards which mandate less then ten pounds PSI at the nozzle.

A pending patent application which two of the inventors of the present invention are the co-inventors having Ser. No. 07/258,508 filed Oct. 17, 1988 teaches an improvement to volume of air at the nozzle and changes the configuration of the venturi built into the handle to comply with the above referenced environmental requirements.

In our above referenced co-pending application a spring biased ball valve is described for providing a positive pressure to the container of liquid to be sprayed and further for controlling the dispensing of liquid when the spray action is terminated.

The present invention is directed to providing a venturi assembly that is attachable to existing hand held spray guns which will allow these spray guns to comply with the above referenced environmental standards for paint spraying and a newly configured ball valve which eliminates the need for the spring bias which controls the exit of the internal gun pressure used to pressurize the container for delivering paint from the paint container into the nozzle.

SUMMARY OF THE INVENTION

The venturi assembly of the present invention overcomes the above noted problems that prevent existing spray guns from complying with the newly passed environmental laws directed to liquid spray guns of all types and particularly to hand held spray guns generally used to spray paint.

The improved one way ball valve of the invention allows positive control of the entry of paint from the paint storage container to the nozzle for atomized delivery from the nozzle exit.

The improvements which are fully explained and claimed herein are directed to an improved low pressure delivery of liquid from a container, and to provide a better spray pattern at a lower relative pressure at the nozzle as compared to the normal high pressure in the present state of the art existing spray gun to which the accessaries are adaptable.

An existing spray gun of the type commonly used to deliver atomized paint from a nozzle may be modified by the addition of an air passage through the gun body between the nozzle and the source of low pressure air of a high volume exiting the venturi assembly of the present invention and with the other end extending into the liquid container. The air passage includes a one way unbiased ball functioning as a valve positioned in the air passageway. The ball is carried in a valve body which is larger in cross section and length than the diameter of the ball. A removable plug with a portion of a smaller diameter than the valve body which protrudes into one end of the valve body and defines a space between the plug and the valve body. This defined space around the plug leads to the passageway and hence to the container of liquid. In operation when the gun is pressurized with the prescribed air pressure that pressure forces the ball against the end of the plug which only seals off a portion of the volume of air entering from the source with the remaining volume entering the liquid container. For a preselected time span after the pressurized air from the source is terminated when for example the spraying operation of the gun is temporally terminated, pressure remains in the container due to that pressure in the container forcing the ball against a seat which prevents the pressurized air from exiting the liquid container through the air passageway. In order to reduce the pressure or eliminate it completely when the gun is to be inoperative for a period of time greater than the preselected time span, the ball seat at the entrance of the passageway is slightly imperfect that is the seat configuration allows a small calibrated amount of pressurized air from the container to escape into the gun around the ball until the pressure at the opening and in the liquid container are equal or ambient. The calibrated leak is designed to be so slight that no liquid escapes into the spray gun air passages and a positive pressure remains in the container during non-use or rest periods normally expected during conventional spray operations. The calibrated leak allows the pressurized air to the spray gun nozzle to be terminated for short periods of time during which positive pressure remains in the liquid container.

The other accessory or improvement referred to as the venturi assembly can be used with the above described ball valve assembly or alone if the positively pressurized liquid container is not required or desired. The venturi assembly of this invention comprises an assembly that can be attached to the pressurized air receiving opening of a conventional liquid spray gun or the like or to a newly configured liquid spray gun. One end of the venturi assembly is designed to attach to the pressurized air input of a spray gun by means of an adaptable connector which may be of a slightly different configuration for each of the many varieties of conventional spray gun to pressurized air attachment means. An adapter may be attached to the pressurized air opening of the selected spray gun and has a common connector which is formed to connect to the venturi assembly. The other end of the venturi assembly has a fitting for connecting to a source of pressurized air in the range of from 0 PSI to 100 PSI or more. The venturi assembly comprises a body portion the inside of which forms a narrowing cone at the end of which abuts a restricting tube that forming a venturi. An opening from the venturi to the atmosphere is positioned upstream of the venturi for the induction of ambient air into the venturi by the low pressure area created by the venturi during operation of the spray gun. Centrally positioned in the venturi body and extending into the venturi assembly substantially the entire length of the venturi body portion at one end and extending from the body portion toward the liquid spray gun at the other end is a valve actuation rod. Positioned at the venturi body portion end of the valve actuation rod is a ball valve and corresponding seat which controls the pressurized air from the source into the venturi assembly and hence the spray gun. The actuation of the trigger of the spray gun translates the valve actuation rod in the upstream direction allowing pressurized air to enter the venturi assembly and gun. The release of the trigger causes the pressurized air from the source to force the ball valve against the seat terminating pressurized air flow into the venturi assembly and gun.

The downstream opening in the venturi assembly is calibrated so that with a given air pressure from the source the pressure leaving the venturi assembly is no greater that the allowable gun nozzle exit pressure under the current environmental limits.

An object of this invention is to provide an adapter for conventional liquid spray guns or the like which allows those liquid spray guns or the like to comply with the current environmental nozzle exit pressure maximum which shall not exceed 10 PSI at the nozzle exit.

Another object of this invention is to provide an adapter to a conventional existing liquid spray gun or the like which includes a valve for controlling the pressurized air into the venturi and into the liquid spray gun or the like.

Another object of this invention is to provide an input pressurized air valve in the venturi assembly which is controllable from the actuation of the spray gun or the like.

Still another object of this invention is to provide a pressure reducing venturi assembly which is completely independent of the spray gun to which it attaches.

These and other objects of the present invention will become apparent from consideration of the following description, taken in conjunction with the accompanying drawings, in which:

BRIEF DESCRIPTION OF THE DRAWING FIGURES

DETAILED DESCRIPTION OF THE PREFERRED EMBODIMENTS OF THE INVENTION

Referring now to the various components of the spray gun including the new improvements incorporated therein.

Figure 1:
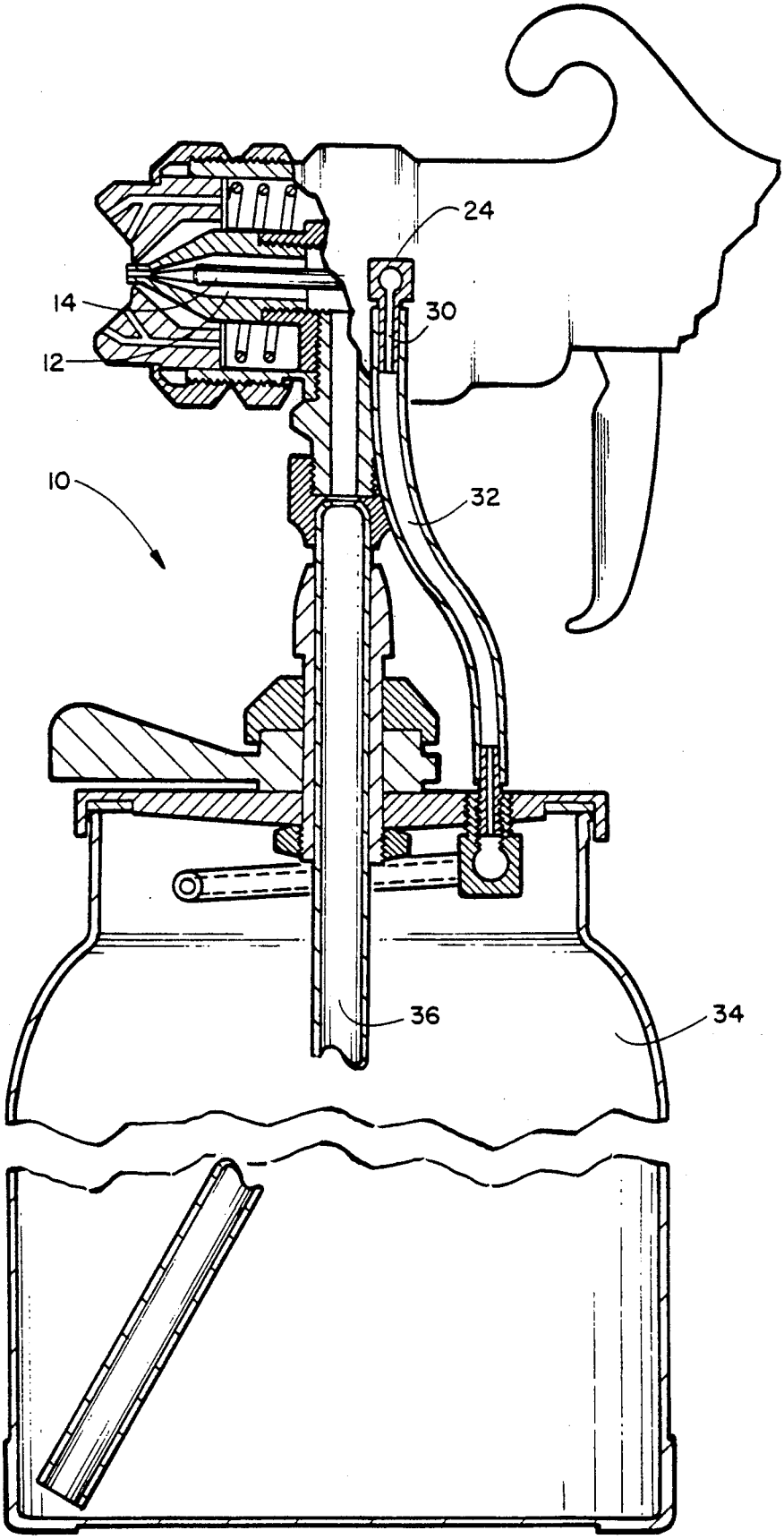
FIG. 1 is a partial cutaway showing of a conventional liquid spray gun and liquid container with the container pressure valve of the present invention.
Figure 2:
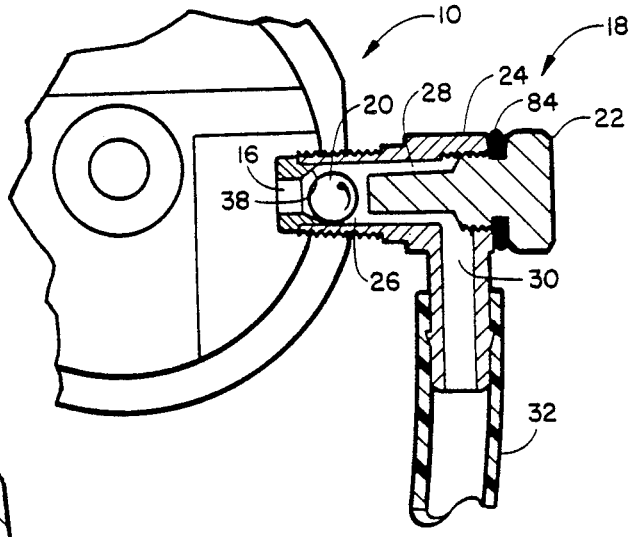
FIG. 2 is a partial cutaway showing of the details of the pressure valve of FIG. 1.

Referring now specifically to drawing FIGS. 1 and 2, FIG. 1 depicts the head and liquid container of a conventional and well know liquid spray gun 10 of the hand held variety. It should be understood that the invention is not intended to be limited to the type of liquid spray depicted and could be employed in any liquid spray device employing the same principles of operation. Generally stated, pressurized air enters the gun and flows through the nozzle area when the nozzle valve 11 is translated toward the right side of the drawing by actuation of the trigger or other form of actuation means herein after described. The trigger simultaneously opens a valve to the source of pressurized air for the spray gun operation. The air pressure within the gun in addition to exiting the nozzle 12 in the form of atomized liquid from the container enters orifice 16 of the check valve 18. Pressurized air entering the orifice forces the ball 20 against the valve screw 22 opening the pathway through the orifice into the check valve. The orifice 16 may be formed in the valve body 24 by any conventional means such as a screw in attachment as shown or as a bore or the like through the end of the valve body. The end of the valve screw 22 facing the ball 20 is less in diameter than the chamber 26 of the valve body. The difference in diameter between the chamber of the valve body and the valve screw provides a space 28. This space 28 provides a passage means for the pressurized air to enter the passage way 30 at a reduced volume. This pressurized air flows through connecting tube 32 into the liquid container 34 pressurizing the contents thereof. Exit tube 36 delivers liquid from the container 34 on demand from the action of the nozzle valve.

When the demand for delivery to the nozzle is terminated, the pressurized air within the sprayer is terminated and the pressure remaining in the container 34 forces the ball 20 against the orifice valve seat 38 which prevents liquid from the container from flowing through the check valve 18. The valve seat 38 does not form a perfect seal for the containment of the pressurized air from the container. The seat is intentionally imperfect so as to allow the pressure to slowly bleed from the container during long periods of non-use of the sprayer and yet holds that pressure for a preselected time span during temporary non-use of the gun which is normal during spray painting or the like. The valve seat can be scribed or the like with a single indentation or the like to establish a selected container bleed down time.

Figure 4:
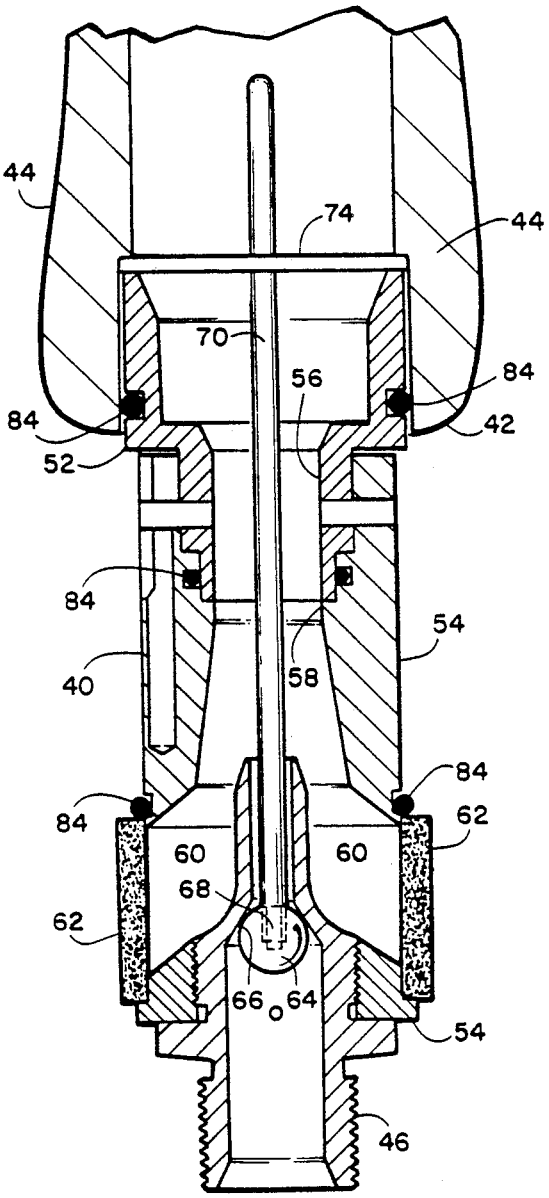
FIG. 4 is a detailed showing in cutaway of the venturi assembly of the invention.
Figure 3:
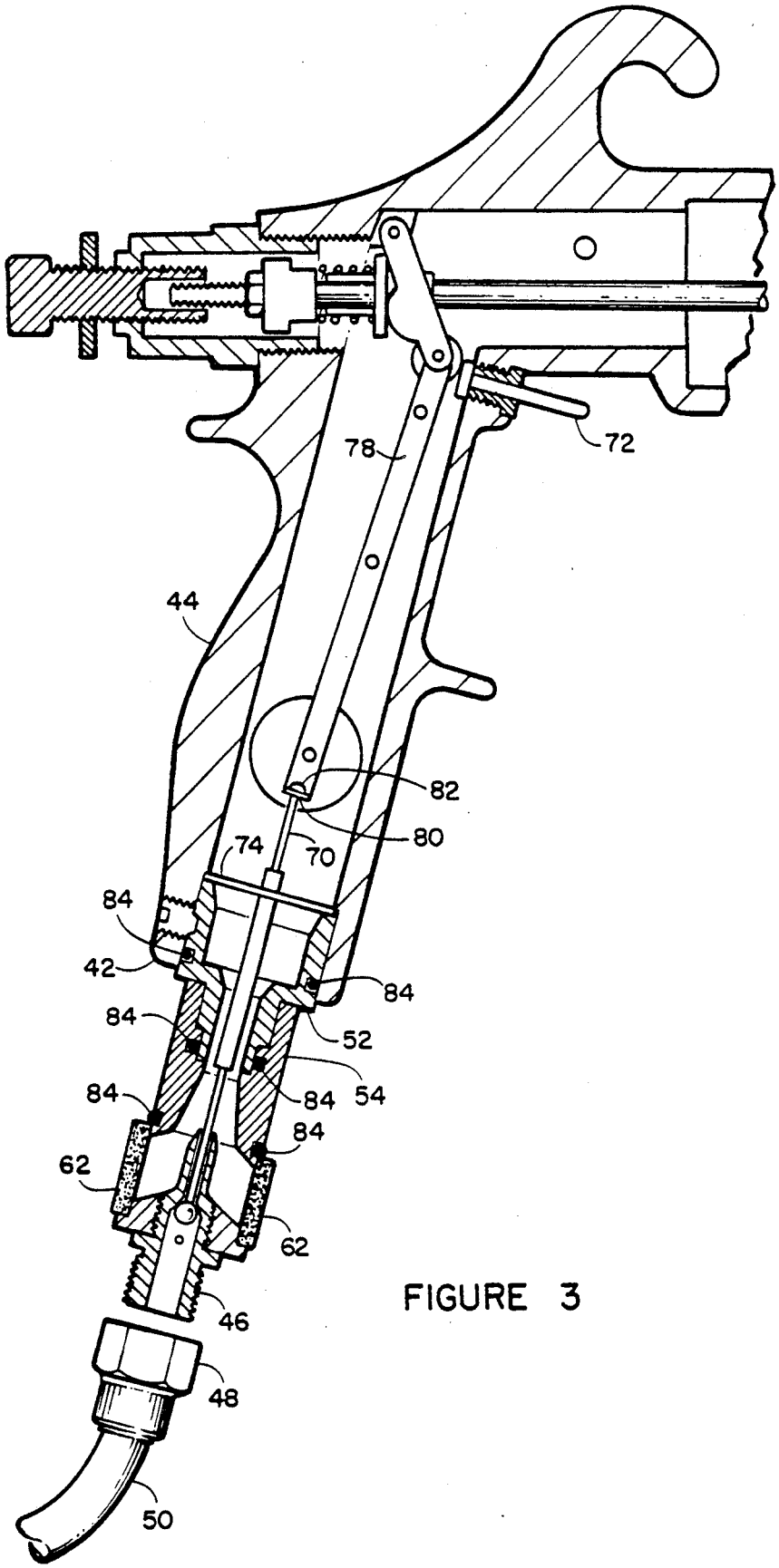
FIG. 3 is a partial showing of a liquid spray gun in cutaway showing the venturi assembly of the present invention.

Referring now to FIGS. 3 and 4, FIG. 3 depicts a portion of the handle of a conventional liquid spray gun 10 with one end of the venturi assembly 40 of the invention attached to the end 42 of the handle 44. The upstream end of the venturi assembly is attached to a source of pressurized air in the range of from 0 to 100 PSI or greater by means of male threaded connector 46 which threadedly attaches to female connector 48 attached to the distal end of the pressurized delivery hose 50.

The venturi assembly comprises an adapter housing 52 which is adapted to connect to the pressurized air input to the liquid spray gun shown. Adapter housing 52 is interconnected to a second housing 54. The venturi housings 54 has an internal bore in the shape of a cone with the smallest diameter of the cone having an abutting relationship with cylindrical interconnecting channel 56 and 58, thereby forming a venturi section. The upstream end of housing 54 includes a plurality of apertures 60 leading into the large end of the cone bore. These apertures 60 may be covered with a filter member 62 to prevent contaminants from entering the spay gun interior along with ambient air.

A valve 64 comprising a seat 66 and a ball 68 is contained in the male connector 46 for controlling the pressurized air from the source entering the venturi assembly and hence the liquid spray gun. The valve is actuated via a rod 70 which extends through the venturi assembly into the handle to connected with the gun valve actuation device, shown in this embodiment as a trigger actuated device 72. The rod 70 is guided by means of a guide bracket 74 through which it passes. Actuation of the trigger forces the trigger activated device toward the rear of the gun translating the actuator rod 78 which engages the end of rod 70 toward the end 42 of the handle moving the ball 68 from the seat and allowing pressurized air to enter the venturi assembly. The action of the pressurized air entering the venturi area of the venturi assembly draws in ambient atmospheric air into the venturi area which mixes with the pressurized air reducing the pressure of that pressurized air to a level that will provide no more than 10 PSI at the nozzle exit and yet provide substantial increase of volume to operate the liquid spray gun in its expected manner.

The connection between the actuator rod 78 and rod 70 may be by way of ball 80 and socket 82 as shown.

The various sections of the venturi assembly and the valve screw to valve body are sealed by means of appreciate "O" ring seals 84 located as shown in drawing FIGS. 2-4.

Specific details of the spray gun can be found in the above referenced co-pending patent application.

What is described is an improvement for conventional state of the art liquid spray guns or the like so that those spray guns or the like will comply with the new environmental standards of nozzle exit pressure and will have a positive delivery of liquid from a storage container associated with the liquid spray gun on demand.

While we have shown and described the preferred embodiments of our invention, it will become apparent to those skilled in the art that there are many modifications and changes which may be made therein without departing from the spirit and scope of the invention.

What is claimed is:

1. A selectively removable external attachment for a conventional liquid spray device, said liquid spray device having a body with an exit nozzle at one end thereof and a handle having an upstream distal end at the other end of said body, an attachment means at the upstream distal end of said handle for attaching said liquid spray device to a source of pressurized air in the range of 0 to over 100 PSI and a valve actuating means, said external attachment being employed for reducing the pressure of said pressurized air entering said liquid spray device to a pressure level of 10 PSI or less at the exit nozzle while substantially maintaining the same volume of air to said spray device comprising:

a venturi assembly for attaching in series between said attachment means of said spraying device and said source of pressurized air, said venturi assembly comprises a first downstream and a second upstream interconnected body portions, said second upstream portion having a conical shaped passageway at its upstream end with a cylindrical passageway extending downstream therefrom, said first downstream body portion having a conical shaped passageway at the downstream end and a cylindrical passageway extending therefrom upstream, said cylindrical passageways of said body portions having an abutting restrictive relationship whereby a venturi is formed, a plurality of bores extend from the outer surface of said second upstream body portion to the venturi area for allowing ambient air to be drawn into said venturi area by the action of the venturi to mix with the pressurized air from said source entering the upstream of said external attachment thereby reducing the pressure of said air prior to entering said spray device while substantially maintaining the volume of pressurized air entering said spray device that is required by said spray device for normal operation.

2. The invention as defined in claim 1 wherein said first downstream body portion has a connector means for attaching to said attachment means of said liquid spray device.

3. The invention as defined in claim 1 wherein said second upstream body portion has a connector member for connecting said selectively removable attachment to said source of pressurized air.

4. The invention as defined in claim 2 additionally comprising pressure sealing means positioned between said body portions and said venturi assembly connection to said attachment means.

5. The invention as defined in claim 1 wherein said venturi assembly further comprises a valve for controlling the pressurized air entering the venturi assembly.

6. The invention as defined in claim 1 wherein said bores are covered with a filtering member.

7. The invention as defined in claim 5 wherein said valve is actuated by said valve actuating means.

8. The invention as defined in claim 1 further comprises a liquid container and means for communicating with the inside of said spray device and container, for admitting liquid from said container into said spray device, for spraying from said nozzle, and an air passage means extending from the inside of said spray device adjacent to said nozzle in the area of pressurized air having a pressure no greater than 10 PSI into said liquid container, which is pressurized thereby when said spray device is in operation.

9. The invention as defined in claim 8 wherein said air passage means includes a one way valve.

10. The invention as defined in claim 9 wherein said one way valve includes a calibrated predetermined leak whereby the pressure in the container established by said air passage means during spray operations is released slowly after a predetermined time span of spray device non-use.

11. The invention as defined in claim 9 wherein said one way valve comprises an imperfect valve seat and a ball valve member whereby when the pressure in the container is less than the pressure in said spray device said ball is positioned thereby for allowing air into said container and when the pressure in said container is greater than the pressure in said spray device the ball is positioned against said imperfect valve seat allowing said pressure in said container to bleed off over a predetermined span of time.

* * * * *